US007260853B2

(12) United States Patent
Newman

(10) Patent No.: US 7,260,853 B2
(45) Date of Patent: Aug. 28, 2007

(54) ODOR ABSORBING SYSTEM AND METHOD

(75) Inventor: Anthony E. Newman, Shakopee, MN (US)

(73) Assignee: Sunburst Companies, Inc., Shakopee, MN (US)

( * ) Notice: Subject to any disclaimer, the term of this patent is extended or adjusted under 35 U.S.C. 154(b) by 20 days.

(21) Appl. No.: 11/024,510

(22) Filed: Dec. 29, 2004

(65) Prior Publication Data

US 2005/0278820 A1 Dec. 22, 2005

Related U.S. Application Data

(60) Provisional application No. 60/580,303, filed on Jun. 16, 2004.

(51) Int. Cl.
*A41B 1/00* (2006.01)

(52) U.S. Cl. ..... 2/115; 2/94; 2/55

(58) Field of Classification Search ..... 2/69, 2/53, 54, 55, 56, DIG. 1, 97, 94, 115, 912
See application file for complete search history.

(56) References Cited

U.S. PATENT DOCUMENTS

| | | | | | |
|---|---|---|---|---|---|
| 2,615,754 | A | * | 10/1952 | Lindenberg | 239/36 |
| 2,719,976 | A | * | 10/1955 | Sussman | 450/104 |
| 3,333,585 | A | | 8/1967 | Barghini et al. | 128/212 |
| 3,922,723 | A | | 12/1975 | Popper | 2/113 |
| 4,228,549 | A | | 10/1980 | Rispoli | 2/239 |
| 4,244,059 | A | * | 1/1981 | Pflaumer | 2/400 |
| 4,285,468 | A | * | 8/1981 | Hyman | 239/55 |
| 4,433,024 | A | | 2/1984 | Eian | 428/198 |
| 4,539,982 | A | | 9/1985 | Bailly | 128/156 |
| 4,663,780 | A | * | 5/1987 | Rawlings et al. | 2/53 |
| 4,810,102 | A | | 3/1989 | Norton | 383/4 |
| 4,826,497 | A | | 5/1989 | Marcus et al. | 604/359 |
| 4,872,220 | A | | 10/1989 | Haruvy et al. | 2/243 |
| 5,042,088 | A | * | 8/1991 | Sherrod et al. | 2/53 |
| 5,112,666 | A | | 5/1992 | Langston | 428/104 |
| 5,122,407 | A | | 6/1992 | Yeo et al. | 428/138 |
| 5,159,718 | A | | 11/1992 | Moyer | 2/69 |
| 5,197,208 | A | | 3/1993 | Lapidus | 36/43 |
| 5,326,305 | A | * | 7/1994 | Fochler | 450/57 |
| 5,383,236 | A | | 1/1995 | Sesselmann | 2/243.1 |
| 5,539,930 | A | | 7/1996 | Sesselmann | 2/243.1 |
| 5,593,398 | A | * | 1/1997 | Weimer | 604/359 |
| 5,790,987 | A | | 8/1998 | Sesselmann | 2/243.1 |
| 5,809,577 | A | * | 9/1998 | Getz | 2/406 |
| 6,009,559 | A | | 1/2000 | Sesselmann | 2/243.1 |
| 6,134,718 | A | | 10/2000 | Sesselmann | 2/243.1 |
| 6,348,423 | B1 | * | 2/2002 | Griffiths et al. | 442/123 |
| 2001/0010098 | A1 | * | 8/2001 | Moretti | 2/97 |

* cited by examiner

FOREIGN PATENT DOCUMENTS

WO WO 2005/032289 A2 * 4/2005

*Primary Examiner*—Katherine Moran
*Assistant Examiner*—Richale L Haney
(74) *Attorney, Agent, or Firm*—Westman, Champlin & Kelly, P.A.

(57) ABSTRACT

An odor absorbing system for use by a person to reduce odor emanation from the person into an environment surrounding the person includes an article of clothing that is configured to be worn by the person and an odor absorbing insert removably attached to the article of clothing. The article of clothing includes a base layer that is adapted to substantially surround a portion of the person wearing the article of clothing. The base layer includes a vent. The odor absorbing insert is configured to cover the vent and includes a layer of breathable material and an odor absorbing agent on the layer of breathable material.

51 Claims, 11 Drawing Sheets

ODOR ABSORBING SYSTEM AND METHOD

The present application is based on and claims the benefit of U.S. provisional patent application Ser. No. 60/580,303, filed Jun. 16, 2004, the content of which is hereby incorporated by reference in its entirety.

FIELD OF THE INVENTION

The present invention generally relates to an odor absorbing system configured to reduce odor emanation from a person into an environment surrounding the person and, more particularly, to an odor absorbing system that includes an article of clothing and at least one odor absorbing insert that is removably attachable to the article of clothing. Additional aspects of the present invention are directed to methods of using the system.

BACKGROUND OF THE INVENTION

Outdoorsmen and women, particularly hunters, often take steps to prevent their detection by wildlife. Such steps include making themselves less visibly detectable to wildlife by, for example, hiding in a tree-stand or wearing camouflaging clothing.

Such wildlife detection preventing methods also include reducing the likelihood of being detected by scent. For example, animals positioned downwind of the person can easily smell bodily odors including natural body secretions. Other bodily odors that are detectable by animals include odors resulting from soaps, perfumes, shampoos, deodorants and other products that are applied to the body. Other strong animal-detectable odors include those embedded in our clothes that are acquired from the environment, such as cigarette smoke, odors from a cleaning detergent or fabric softener applied to the clothes when washed, and other odors.

Articles of clothing have been developed to prevent odor emanation from the person wearing the article of clothing. Examples of such articles of clothing are described in U.S. Pat. Nos. 5,383,236, 5,539,930, 5,790,987, 6,009,559 and 6,134,718 (hereinafter "Sesselmann patents"). Briefly, the patents describe articles of clothing that are formed of a base layer on which a scent absorbing means is "provided" by bonding a scent absorbing agent to a surface of the base layer through a silk-screen printing process.

The Sesselmann patents incorrectly claim that when the scent absorbing means is activated charcoal, it may be reactivated merely by machine washing and drying the article of clothing. However, reactivation of activated charcoal requires a much more complicated process that cannot be performed by washing or drying machines. Instead, the only way to "reactivate" activated charcoal is through a process called pyrolysis in which the activated charcoal is heated to over 1400° F. (800° C.) in a controlled atmosphere of low oxygen.

Accordingly, the useful scent absorbing lifespan of the activated charcoal is limited and basically non-renewable. the process used to renew the activated charcoal is generally too complicated to be performed by non-renewable for those who lack the equipment needed to perform the pyrolysis operation. More particularly, the rate at which the activated charcoal absorbs odors decreases with use to a point where it is no longer useful for scent absorbing purposes. As a result, the entire scent absorbing clothing described in the Sesselmann patents must periodically be replaced in order to maintain the desired scent absorbing performance.

Additionally, since the scent absorbing agent is bonded directly to the base layer that forms the article of clothing, the scent absorbing performance of the article of clothing will decrease during the manufacture and transportation of the odor absorbing base layer material and the article of clothing that is formed of the odor absorbing base layer material. For instance, the odor absorbing base layer material that is ultimately used to form the article of clothing is typically transported in a manner that exposes the material to odors in the environment. Additionally, once the odor absorbing base layer material is received by the manufacturer of the article of clothing, the material is further exposed to odors. Such near continuous exposure to odors decreases the useable odor absorbing lifespan of the base layer material and the article of clothing that is formed of the material.

Furthermore, the articles of clothing of the Sesselmann patents are also likely to be exposed to odors during periods of nonuse. For example, articles of clothing in the form of jackets or pants that are formed of the scent absorbing base layer material are typically exposed to odors in the closet or drawer, in which they are stored during periods of non-use. As a result, the useful scent absorbing lifespan of the clothing continues to decrease even while it is not being worn.

A continuing need exists for ways to reduce personal odor emanation during outdoor activities, such as hunting, while avoiding the waste associated with odor absorbing clothing of the prior art that must be periodically replaced to maintain a desired level of odor absorbing performance.

SUMMARY OF THE INVENTION

The present invention is generally directed to an odor absorbing system for use by a person to reduce odor emanation from the person into an environment surrounding the person. The system includes an article of clothing that is configured to be worn by the person and an odor absorbing insert removably attached to the article of clothing. The article of clothing includes a base layer that is adapted to substantially surround a portion of the person wearing the article of clothing. The base layer includes a vent. The odor absorbing insert is configured to cover the vent and includes a layer of breathable material and an odor absorbing agent on the layer of breathable material.

Another aspect of the present invention is directed to a method of using the odor absorbing system described above to reduce odor emanation from the person into an environment surrounding the person. In the method, an article of clothing is provided that is configured to be worn by the person. The article of clothing includes a base layer having a vent. Next, the vent is covered with an odor absorbing insert having a layer of breathable material and an odor absorbing agent on the layer of breathable material. Finally, the article of clothing is worn by the person such that the base layer substantially surrounds at least a portion of the person.

Other features and benefits that characterize embodiments of the present invention will be apparent upon reading the following detailed description and review of the associated drawings.

DETAILED DESCRIPTION OF THE PREFERRED EMBODIMENTS

Figure 1A:
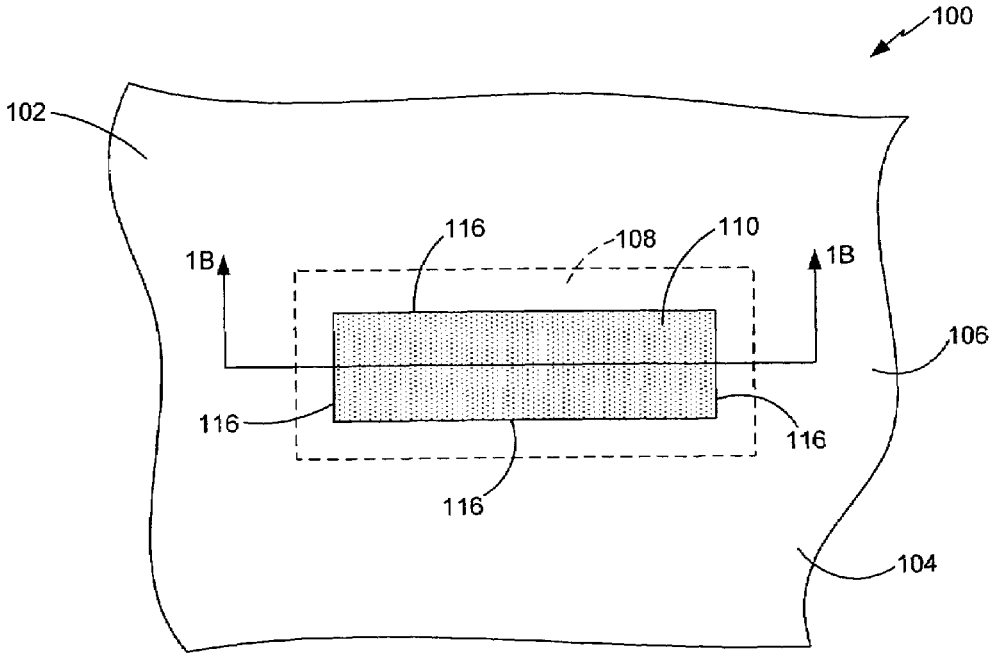
FIG. 1A is a front plan view of a portion of an odor absorbing system in accordance with embodiments of the invention.
Figure 1B:
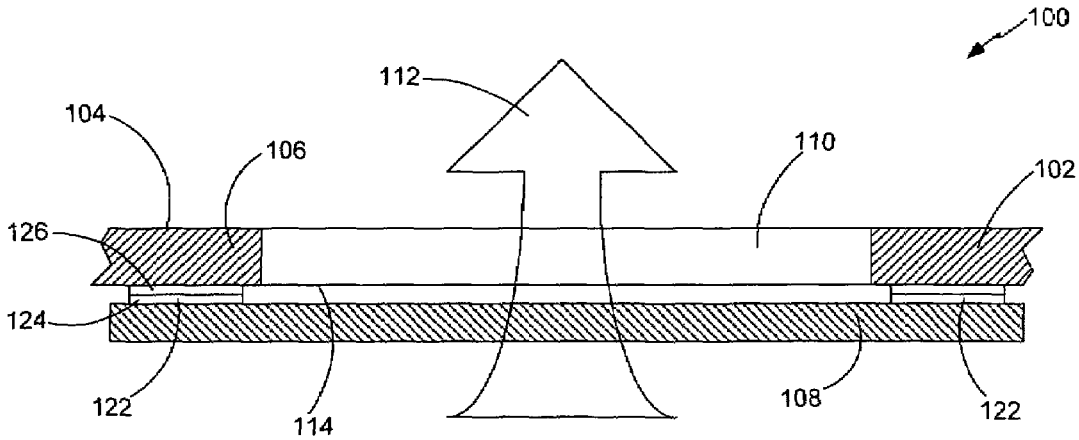
FIG. 1B is a cross-sectional view of the system depicted in FIG. 1A taken generally along the line 1B-1B.

The present invention is generally directed to an odor absorbing system 100, shown in FIGS. 1A and 1B, for use by a person to reduce odor emanation from the person into an environment surrounding the person. FIG. 1A is a partial front plan view of the system 100 in accordance with embodiments of the invention. FIG. 1B is a cross-sectional view of the system 100 depicted in FIG. 1A taken generally along line 1B-1B.

The system 100 includes an article of clothing 102, an exterior side 104 of which is shown in FIG. 1, that includes a base layer 106 that is configured to substantially surround a portion of the person wearing the article of clothing 102. In other words, the base layer 106 forms the body covering structure of the article of clothing 102. Additionally, the system 100 includes at least one odor absorbing insert 108 that is configured to cover at least one vent 110 in the base layer 106 of the article of clothing 102. The odor absorbing insert 108 is configured to adsorb or absorb odors emanating from the person to prevent them from entering the environment surrounding the person. Hereinafter, the term "absorb" will be used to describe both adsorbing and absorbing functions.

Preferably, the odor absorbing inserts 108 and vents 110 are positioned on the article of clothing 102 such that, when the article of clothing 102 is worn by a person, they are likely to be positioned adjacent to primary odor-producing areas of the body. Examples of primary odor-producing areas include the armpits, the shoulders, the neck, the crotch area, and the mouth of the person.

Each vent 110 allows for an airflow 112 (outgoing airflow) to be directed through a specific location of the base layer 106 where the odor absorbing insert 108 is placed. As a result, outgoing airflows 112 are directed through the vent 110 and the odor absorbing insert 108 covering the vent 110 which absorbs odors in the airflow 112 to thereby reduce odor emanation from the person wearing the article of clothing 102 into the surrounding environment.

It should be understood that the term "vent", as used herein, is intended to describe an opening through the base layer 106 whose purpose is to allow air to flow from inside the article of clothing 102 to the outside environment, when the article of clothing 102 is worn by a person. Thus, for example, when the article of clothing 102 is in the form of a jacket and is being worn by a person, the vent 110 within the base layer 106 allows the airflow 112 to pass between an interior side 114 of the base layer 106 that is closest to the person's body and the environment that is on the exterior side 104 of the base layer 106 that is opposite the interior side 114.

However, the vent 110 of the present invention is distinguishable from a primary opening that is configured to accommodate a pass-through for a portion of the person wearing the article of clothing. For example, a primary opening at a neckline of an article of clothing in the form of a jacket is not a "vent" as the term is used herein since the opening at the neckline accommodates the neck of the person wearing the jacket. Similarly, a waistline of the jacket that is configured to accommodate a waist of the person wearing the jacket is not a "vent" as the term is used herein. Other examples of non-vent or primary openings in articles of clothing include the opening at a cuff of a sleeve of a shirt or jacket, a waistline of pants, and a cuff at the end of a pant leg.

Figure 2A:
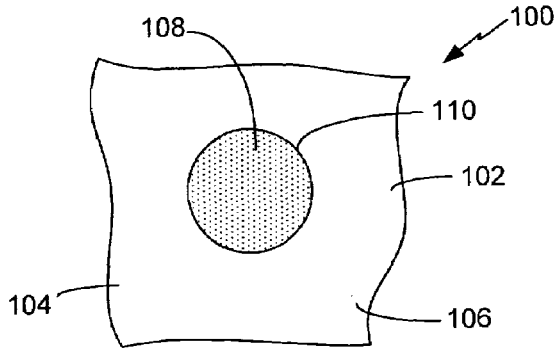
FIGS. 2A-2E illustrate vents in a base layer of an article of clothing of the odor absorbing system in accordance with embodiments of the invention.
Figure 2B:
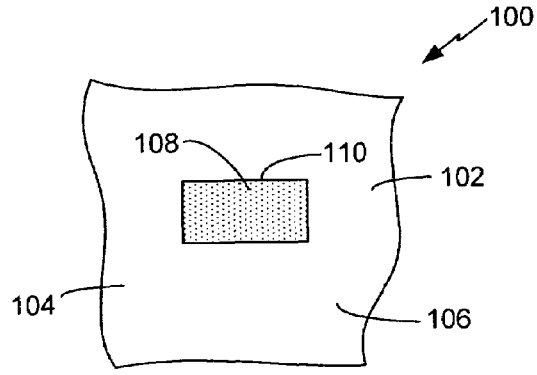
Figure 2C:
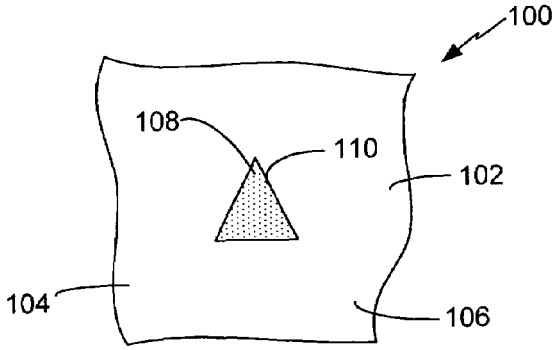
Figure 2D:
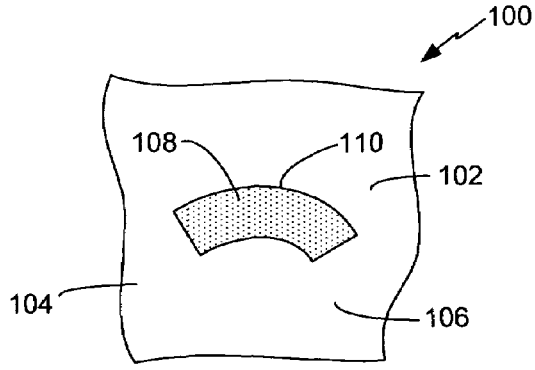
Figure 2E:
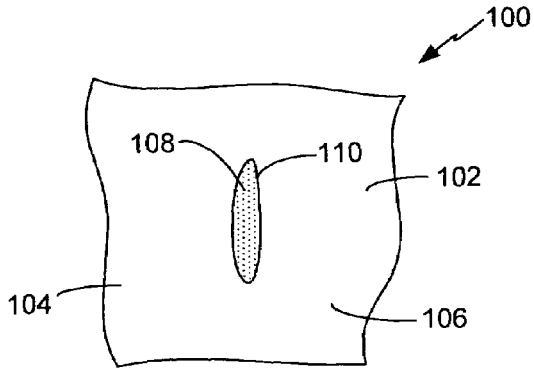

The shape of the vents 110 of the system 100 of the present invention can vary depending on their location. In accordance with one embodiment of the invention, the vents 110 include sides, generally designated as 116, that are displaced from each other when the base layer 106 is laid flat. In other words, one embodiment of the vents 110 of the present invention are formed by removing a portion of the base layer 106 rather than simply making a slit in the base layer 106. The vents 110 can be any desired shape including rectangular (FIG. 2A), circular (FIG. 2B), triangular (FIG. 2C), irregular (FIG. 2D), symmetrical, or other shape. In accordance with another embodiment of the invention, at least one of the vents 110 is formed by making a slit in the base layer 106, as illustrated in FIG. 2E. In accordance with one embodiment of the invention, a breathable material (not shown), such as a mesh, spans the vent and is attached to the sides 116 of the base layer 106.

Figure 3:
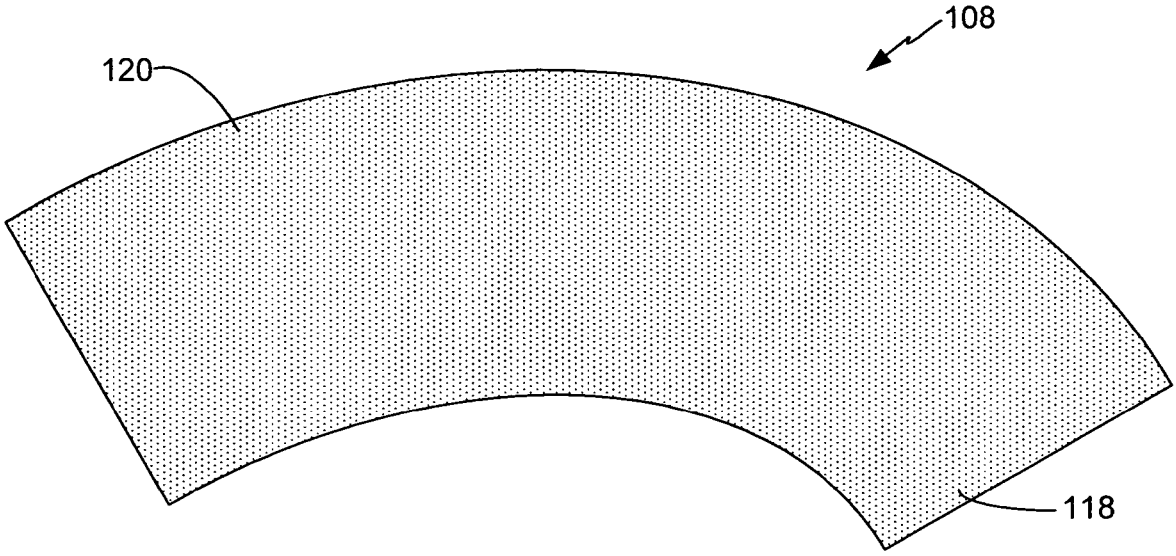
FIG. 3 is a top plan view of an odor absorbing insert in accordance with embodiments of the invention.

FIG. 3 is a top plan view of an odor absorbing insert 108 in accordance with embodiments of the invention. In general, the odor absorbing insert 108 is configured to cover the vent 110 in the base layer 106, as illustrated in FIGS. 1A and 1B. Although depicted as covering the interior side 114 (FIG. 1B) of the vent 110, the odor absorbing insert 108 could be positioned to cover the exterior side 104 of the vent 110 in the base layer 106.

The odor absorbing inserts 108 can be formed of any desirable shape and is sized to preferably cover the entire vent 110. The odor absorbing insert 108 generally includes a layer of breathable material 118 on which an odor absorbing agent 120 is applied. The layer of breathable material 118 includes a substantially porous material through which an airflow (such as airflow of FIG. 1) can easily travel. Embodiments of the layer of breathable material include a mesh, cotton, polypropylene, wool, polyester, or other breathable fabric or material.

The odor absorbing agent 120 is preferably bonded to one or more surfaces of the layer of breathable material 118 in accordance with known methods. The odor absorbing agent 108 preferably includes activated carbon or charcoal. Alternatively, the odor absorbing agent 120 can be formed of other known odor absorbing materials, such as chlorophyll, baking soda, activated alumni, soda, lime, zeolite, calcium oxide, potassium permanganate, and cyclodextrin.

In accordance with one embodiment of the invention, the odor absorbing insert 108 is configured for removable attachment to the base layer 106 of the article of clothing 102 at the vent 110. For instance, the odor absorbing insert 108 can be attached directly to the base layer 106 of the article of clothing 102 at the vent 110 as shown in FIG. 1B using one or more conventional fasteners 122. For example, a plurality of fasteners 122 can be provided each having one portion 124 attached to the odor absorbing insert 108, and another portion 126 attached to the base layer 106 of the article of clothing 102 at the perimeter of the vent 110. Examples of suitable fasteners include hook and loop fasteners (e.g., velcro®, buttons, zippers, or other suitable fasteners), which allow for the removal of the odor absorbing insert 108 without damaging the article of clothing 102.

Figure 4A:
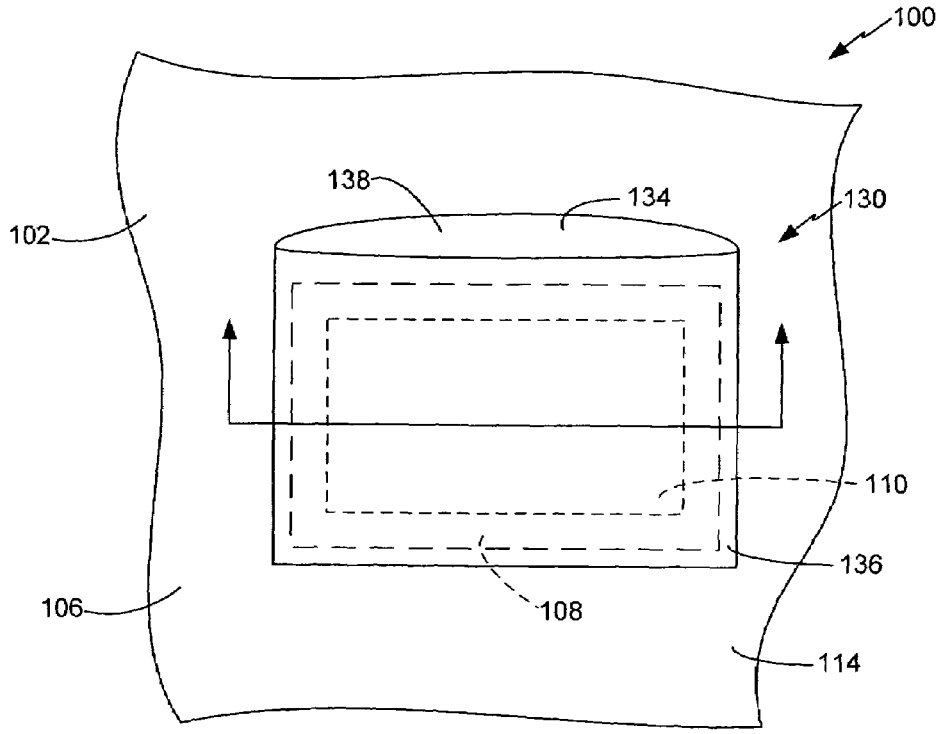
FIG. 4A is a front plan view of an interior side of a portion of an article of clothing of the odor absorbing system in accordance with embodiments of the invention.
Figure 4B:
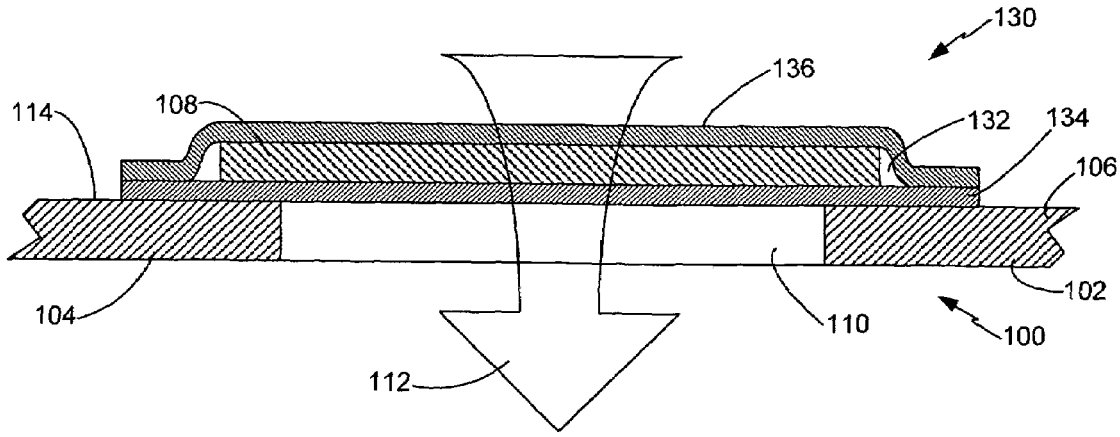
FIGS. 4B and 4C are cross-sectional views of embodiments of the system taken generally along lines 4B-4B of FIG. 4A.

In accordance with another embodiment of the invention, the odor absorbing system 100 includes at least one breathable pocket 130 that is positioned at one of the vents 110 of the article of clothing 102, as shown in FIGS. 4A and 4B. The breathable pockets 130 are used to removably attach the odor absorbing inserts 108 to the article of clothing 102. FIG. 4A is a front plan view of an interior side 114 of the article of clothing 102 and FIG. 4B is a cross-sectional view of the system 100 taken generally along line 4B-4B of FIG. 4A.

Each breathable pocket 130 is preferably attached to a portion (e.g., an inside surface 114) of the base layer 106 at one of the vents 110. An odor absorbing insert 108 is contained in an interior chamber 132 of the breathable pocket. The breathable pocket 130 generally includes first and second layers of breathable material 134 and 136, respectively. The breathable material is preferably highly breathable such that it provides little resistance to an airflow 112 traveling through the vent 110. Examples of suitable breathable materials for use in forming the first and second layers 134 and 136 includes a mesh, a screen, and other highly breathable materials.

In accordance with one embodiment of the invention, the breathable pocket 130 is permanently mounted to the base layer 106. For example, the first and second layers 134 and 136 can be permanently mounted to the base layer 106 by sewing or gluing them to the base layer 106.

Figure 4C:
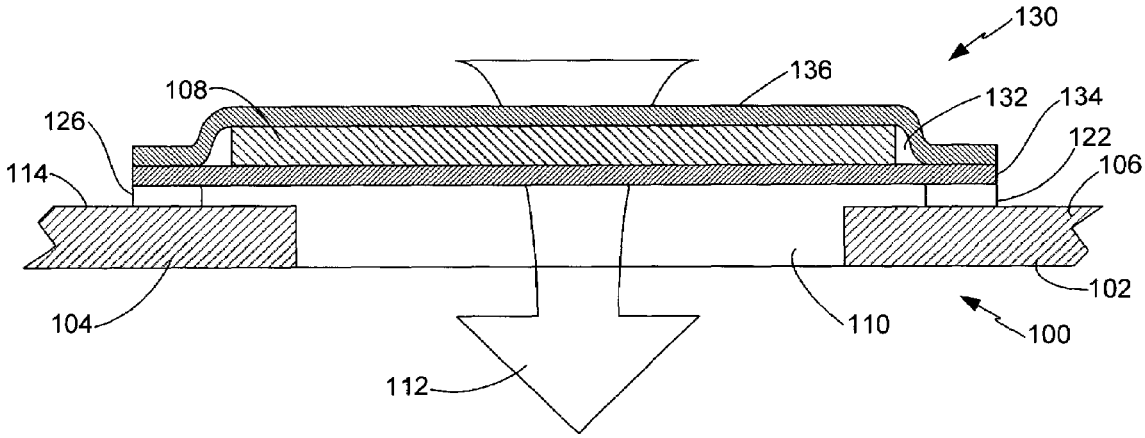

In accordance with another embodiment of the invention, the breathable pocket 130 is removably mounted to the base layer 106. For example, one or both of the layers 134 or 136 are removably mounted to the base layer 106 using suitable fasteners 122 at the perimeter of the breathable pocket 130 such as those described above, as shown in FIG. 4C. Preferably, the first and second layers 134 and 136 of the breathable pocket 130 are permanently connected to each other and the fasteners 122 are used to attach only one of the breathable layers to the base layer 106 at the perimeter of the vent 110. In accordance with this embodiment of the invention, the odor absorbing insert 108 could be non-removably contained in the breathable pocket 130, which is removably attached to the base layer 106 of the article of clothing 102.

Another embodiment of the breathable pocket 130 includes an opening 138 (FIG. 4A) through which the interior chamber 132 defined by the first and second layers 134 and 136 is accessible. The opening 138 can preferably be closed using a suitable fastener, such as those described above.

Additionally, the odor absorbing insert 108 is preferably sized to lay flat within the interior chamber 132 and may be configured to have a shape that substantially conforms to the shape of the interior chamber 132. As a result, the odor absorbing insert 108 can be designed for specific breathable pockets 130 and can be provided with different odor absorbing properties that are tailored to the location of the corresponding breathable pocket 130.

Additionally, the interior chamber 132 of the breathable pocket 130 is preferably only slightly larger in area than the odor absorbing insert 108 when both are laid flat, in order to accommodate the odor absorbing insert 108. Additionally, the interior chamber 132 of the breathable pocket 130 is preferably only slightly larger in volume than the odor absorbing insert 108. As a result, one embodiment of the breathable pocket 130 provides a snug fit for the odor absorbing insert 108. Such a snug fit allows the odor absorbing insert 108 to be held up against the perimeter of the vent 110 to thereby force most of the airflow 112 traveling through the vent 110 to travel through the odor absorbing insert 108 rather than around it.

One embodiment of the article of clothing 102 of the system 100 includes an upper body covering article of clothing 140, shown in FIG. 7. The base layer of the article of clothing 140 generally includes a torso section 142 and arm sections 144 that are attached to the torso section 142. The torso and arm sections 142 and 144 are respectively configured to substantially cover a torso and arms of the person wearing the article of clothing 140. One or more odor absorbing inserts 108 can be removably attached to the upper body article of clothing 140 using any of the methods described above and in the exemplary locations described below.

In accordance with one embodiment of upper body covering article of clothing 140, the base layer 106 includes vents 110 that are located at armpit sections 146 that are adjacent the torso and arm sections 142 and 144. Odor absorbing inserts 108 are positioned to cover the vents 110 at the armpit sections 146 of the base layer 106 such that they will be positioned at the armpits of the person wearing the article of clothing 140 to absorb odors at that primary odor-producing location.

In accordance with another embodiment of the upper body covering article of clothing 140, the vents 110 are located in shoulder sections 148 of the base layer 106. The shoulder sections 148 are adjacent a junction between the torso and arm sections 142 and 144. When the article of clothing 140 is worn by a person, the odor absorbing inserts 108 positioned at the vents 110 of the shoulder sections 148 of the base layer 106 will be positioned next to the shoulders of the person to absorb odors at that primary odor-producing location.

In accordance with yet another embodiment of the upper body covering article of clothing 140, a vent 110 is located below a neckline 150 of the torso section 142 of the base layer 106. When the article of clothing 140 is worn by a person, that vent 110 is positioned to overlay an upper back portion of the person when the vent 110 is located on a back side of the article of clothing 140, or an upper chest portion of the person when the vent 110 is located on a front side of the article of clothing 140. When the odor absorbing insert 108 covers the vent 110 it will be positioned at the upper chest and/or upper back of the person wearing the article of clothing 140.

Figure 6B:
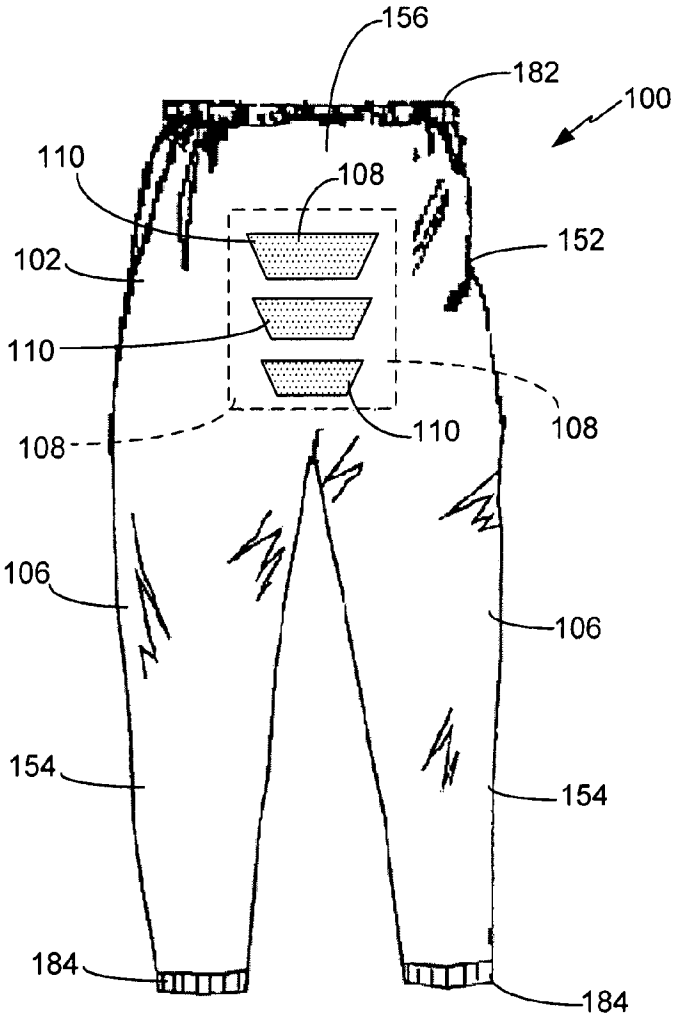
FIGS. 6A and 6B respectively are front and rear views of a lower body covering article of clothing of the odor absorbing system in accordance with embodiments of the invention.
Figure 6A:
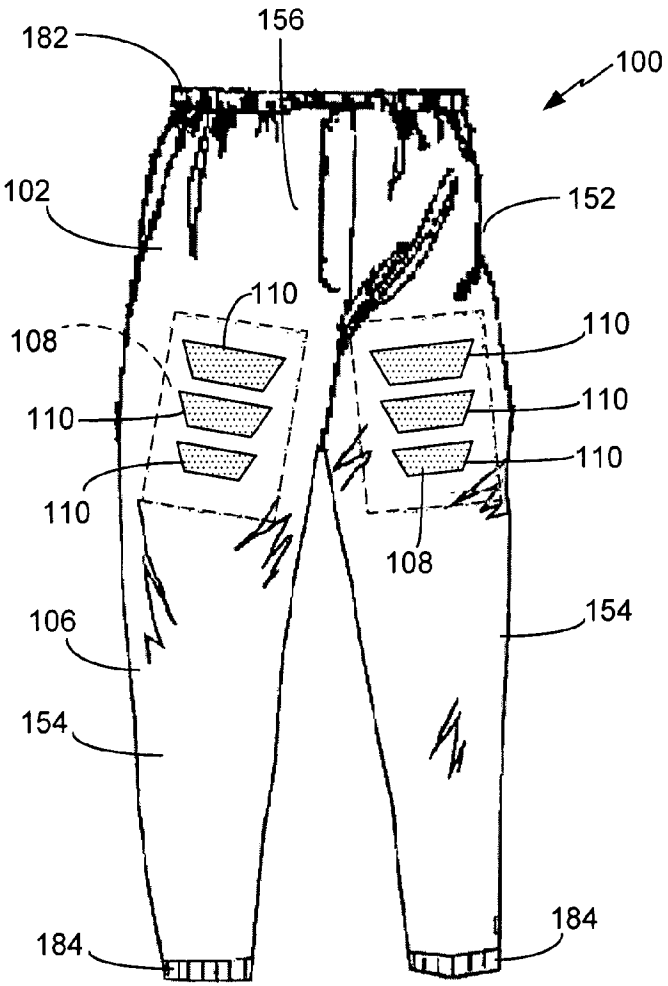

In accordance with another embodiment of the system 100, the article of clothing 102 includes a lower body covering article of clothing 152 shown in the front and back plan views of FIGS. 6A and 6B. The base layer 106 of the lower body covering article of clothing 152 includes pant leg sections 154 that are attached to a crotch section 156. The pant leg sections 154 are each configured to substantially surround the leg of the person wearing the article of clothing 152 and the crotch section 156 is configured to substantially surround a crotch area of the person. The leg sections 154 preferably extend substantially the entire length of the legs of the person, but could be configured to be shorter. In accordance with one embodiment of the lower body covering article of clothing 152, vents 110 are located in the pant leg sections 154 and/or in the crotch section 156 of the base layer 106. The odor absorbing inserts 108 can be removably attached to the lower body article of clothing 152 in these exemplary locations using any of the methods described above.

Figure 7B:
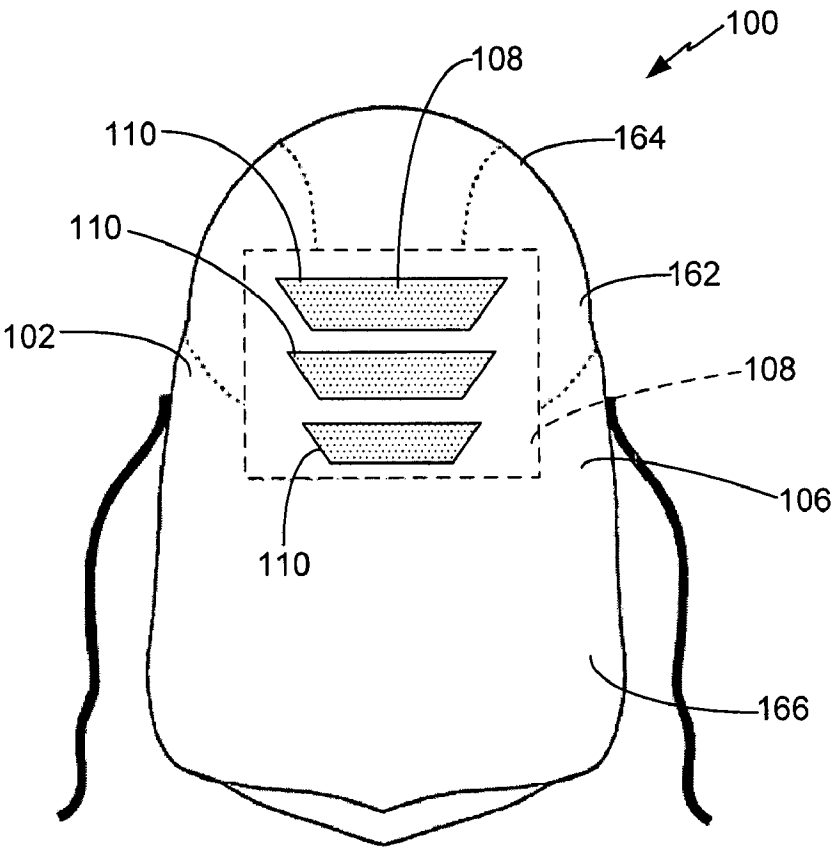
FIGS. 7A and 7B respectively are front and rear views of a head covering article of clothing of the odor absorbing system in accordance with embodiments of the invention.
Figure 7A:
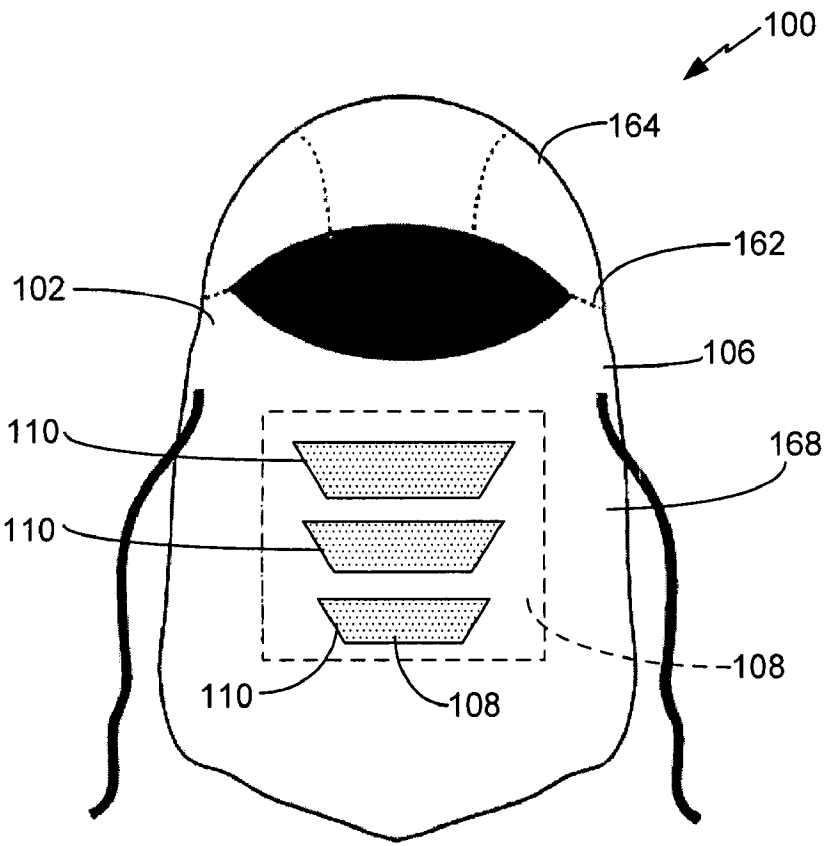

Another embodiment of the article of clothing 102 of odor absorbing system 100 includes a head covering article of clothing 162, front and back views of which are illustrated in FIGS. 7A and 7B. In accordance with one embodiment of the invention, the base layer 106 of the head covering article of clothing 162 includes at least a cap section 164 that is configured to cover a top of a head of the person. In accordance with additional embodiments of the invention, the base layer 106 of the head covering article of clothing 162 including a neck flap 166 (FIG. 7B) configured to overlay a neck of the person wearing the head covering 162, and/or a face cover 168 (FIG. 7A) configured to cover the mouth of the person wearing the head covering 162.

The vents 110 of the head covering article of clothing 162 can be located in the cap section 164 (FIG. 7B), the neck flap 166 (FIG. 7B), and/or the face cover 168 (FIG. 7A), and odor absorbing inserts 108 can be attached at the vents 110 using any of the methods described above. The vent 110 in the face cover 168 is preferably positioned at the mouth of the person wearing the article of clothing such that odors in the outgoing airflow in the form of a breath of the person are absorbed by the corresponding odor absorbing insert 108 at that location.

In accordance with another embodiment of the invention, the article of clothing 102 of the system 100 can also include airflow restriction components that are positioned at the primary openings of the article of clothing 102. Such airflow restriction components are configured to restrict airflows, particularly outgoing airflows from traveling through the primary openings (i.e., the neckline opening, the waistline opening, cuff openings, etc.) in the article of clothing 102 when the article of clothing is worn by a person. By creating such airflow restrictions at the primary openings, more of the outgoing airflows (e.g., airflow 112 shown in FIG. 1B) are directed through the vents 110 of the base layer 106 and the odor absorbing inserts 108 covering the vents 110 to further reduce odor emanation from the person wearing the article of clothing. In accordance with one embodiment of the invention, the base layer 106 is formed of a substantially non-breathable material, which further improves the ability of the system 100 to direct the outgoing airflows 112 through the vents 110 and the odor absorbing inserts 108.

Embodiments of the upper body covering article of clothing 140 include airflow restriction components such as a neckline 170, a waistline 172, and cuffs 174. The neckline 170 is attached to the torso section 142 of the base layer 106 and is configured to squeeze a neck of the person wearing the article of clothing. In other words, the neckline 170 is configured to generate an airflow restrictive seal at the neck of the person that operates to restrict airflow from the interior side of the article of clothing 142 through the primary opening 176 at the neck of the person.

The waistline 172 is attached to the torso section 142 of the base layer 106 and is configured to squeeze a waist of the person wearing the article of clothing 140 to thereby restrict airflow from an interior side of the article of clothing 140 through the primary opening (not shown) at the waist of the person.

Likewise, the cuffs 174 are each attached to an end of one of the arm sections 144 of the base layer 106 and are configured to squeeze a wrist of the person wearing the article of clothing 140 to thereby restrict airflow from an interior side of the article of clothing through the primary openings 178 at the wrists of the person. Each of the airflow restriction components can include an elastic band, a drawstring, or other suitable component, generally indicated at 180, to facilitate the body squeezing function.

One embodiment of the lower body covering article of clothing 152 includes airflow restriction components in the form of a waistline 182 and cuffs 184, shown in FIGS. 6A and 6B. The waistline 182 is attached to the crotch section 156 of the base layer 106 and is configured to squeeze a waist of the person wearing the article of clothing 152 to thereby restrict airflow from an interior side of the article of clothing through the primary opening at the waist of the person. The cuffs 184 are attached at ends of the leg sections 154 of the base layer 106 and are configured to squeeze ankles of the person wearing the article of clothing 152 to thereby restrict airflow from an interior side of the article of clothing through the primary openings at the ankles of the person. The waistline and cuff airflow restriction components 182 and 184 can include elastic bands and/or drawstrings to facilitate the squeezing function as mentioned above.

Additional embodiments of the odor absorbing system 100 of the present invention are based on a recognition that odor absorbing materials have a limited useful odor absorbing lifespan. In fact, as the odor absorbing material absorbs odors, the rate of odor absorption and the remaining amount of odor that the material will be able to absorb decreases. Additionally, odor absorbing materials, such as activated carbon, have odor absorbing properties that cannot be renewed by washing, for instance.

One advantage to the odor absorbing inserts 108 of the present invention is that they can be removed and replaced as needed while maintaining use of the article of clothing 102. As a result, the system 100 of the present invention avoids the problems of prior art odor absorbing articles of clothing that directly bond the odor absorbing material to the base layer that forms the article of clothing, which must be completely replaced periodically in order to maintain a desired odor absorbing performance.

Figure 8:
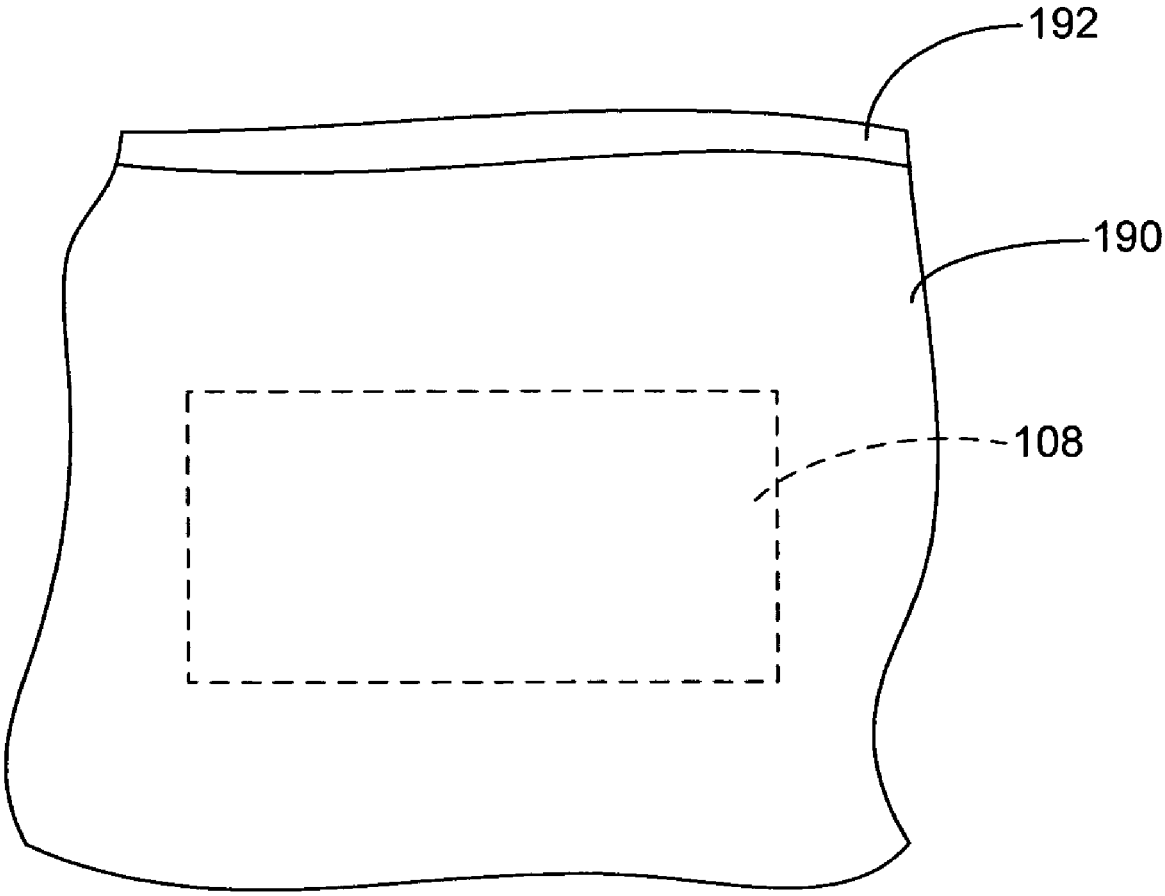
FIG. 8 is a simplified front plan view of a sealable container containing a scent absorbing insert in accordance with embodiments of the invention.

In accordance with one embodiment of the odor absorbing system 100, the odor absorbing insert 108 is stored in a sealed container 190, such as a sealed bag (e.g., a foil bag, or pouch) as illustrated in FIG. 8, a plastic container, or other container that reduces the exposure of the insert to odors. Preferably, the sealed container 190 includes a reusable seal 192, to allow the user of the system 100 to place the scent absorbing insert 108 back in the sealed container 190 during periods of nonuse. In this manner, the scent absorbing insert 108 of the present invention can maintain its odor absorbing properties over longer periods of time as compared to prior art articles of clothing that are generally continuously exposed to environmental odors (even when stored during periods of nonuse), to thereby extend its useful odor absorbing lifespan. Thus, the system 100 also includes a kit that includes the odor absorbing insert in the sealed package 190 and the article of clothing 102.

Figure 5:
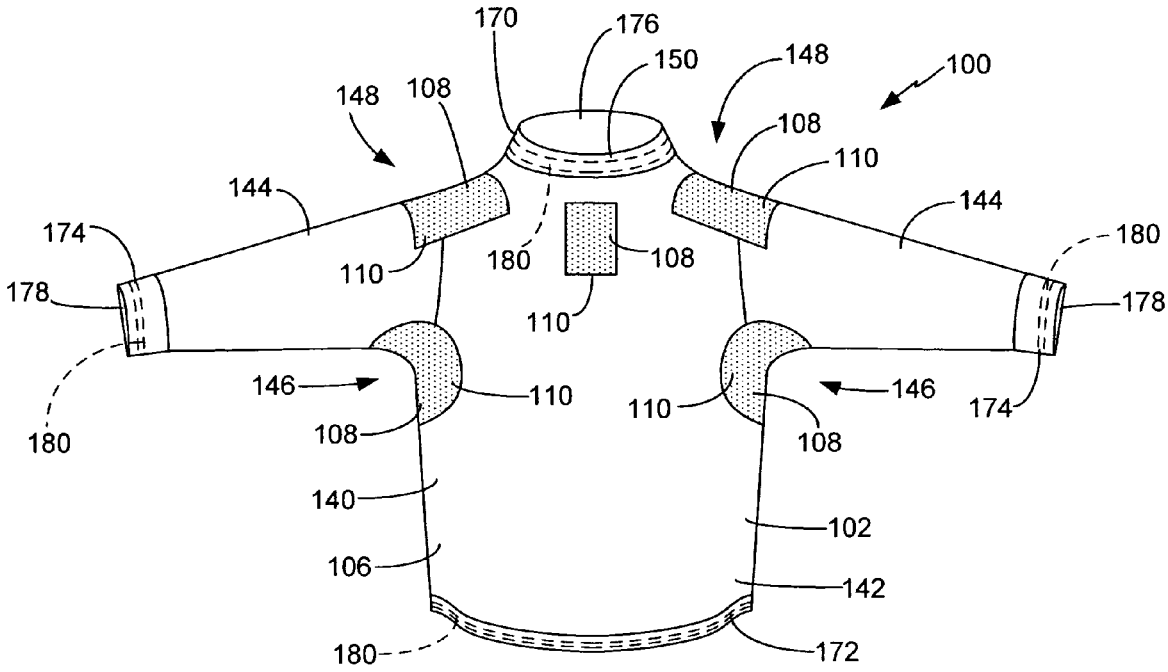
FIG. 5 is a front view of an upper body covering article of clothing of the odor absorbing system in accordance with embodiments of the invention.
Figure 9:
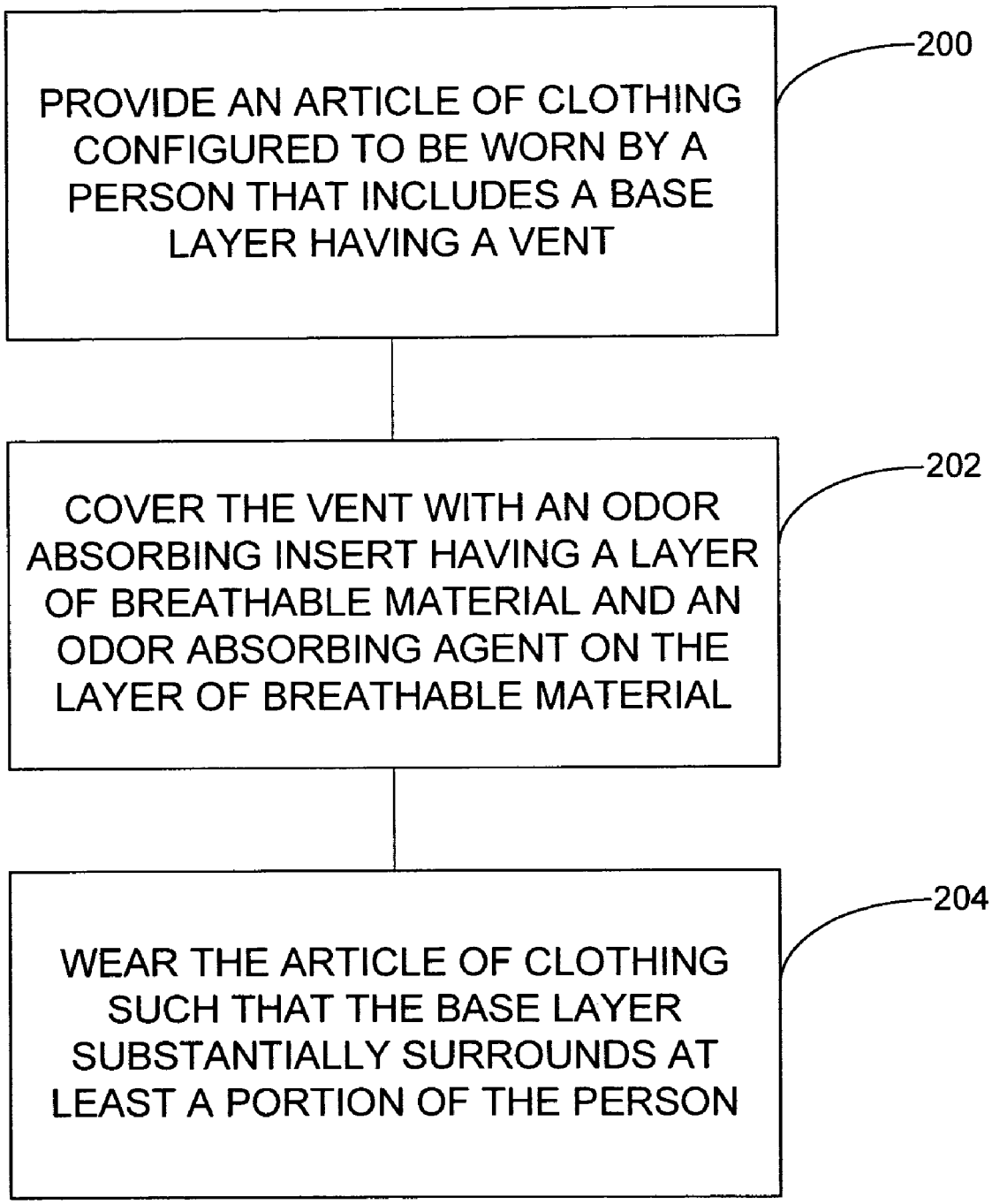
FIG. 9 is a flowchart illustrating a method of using an odor absorbing system in accordance with embodiments of the invention.

One aspect of the present invention is directed to a method of using the odor absorbing system 100 described above to reduce odor emanation from a person into an environment surrounding the person. Steps of the method are illustrated in the flowchart of FIG. 9. At step 200, an article of clothing 102, such as an upper body covering article of clothing 140 (FIG. 5), a lower body covering article of clothing 152 (FIGS. 6A and 6B), and/or a head covering article of clothing 162 (FIGS. 7A and 8A), is provided, which is configured to be worn by a person. The article of clothing 102 includes a base layer 106 having a vent 110. Next, at step 202, the vent 110 is covered with an odor absorbing insert 108 having a layer of breathable material 118 and an odor absorbing agent 120 on the layer of breathable material 118, as shown in FIG. 3. Finally, at step 204, the article of clothing 102 is worn by the person such that the base layer 106 substantially surrounds at least a portion of the person. As a result, outgoing airflows 112 from an interior side 114 of the base layer 106 are directed through the vent 110 and the odor absorbing insert 108, which removes odors in the airflow, to thereby reduce odor emanation from the person into the surrounding environment, as shown in FIG. 1B.

In accordance with one embodiment of the method, the odor absorbing insert 108 is provided in a sealed container or package 190, as described above and the user removes the odor absorbing insert 108 from the sealed package 190 prior to covering the vent 110 in step 202.

In accordance with yet another embodiment of the invention, the method includes performing an outdoor activity, such as hunting wildlife, while wearing the article of clothing with the odor absorbing insert positioned at the vent.

In accordance with one embodiment of the invention, the layer of breathable material 118 of the scent absorbing insert 108 and/or the base layer 106 of the article of clothing 102 includes an anti-microbial fabric having an anti-microbial agent. Such anti-microbial fabrics are available from a number of sources including Sherman Textile Company of Dallas, N.C.; Magna Fabrics of North Bergen, N.J.; and Microban® Products Company of Huntersville, N.C. A preferred anti-microbial fabric is the Microsafe® fabric produced by Microban® Products Company.

Figure 10:
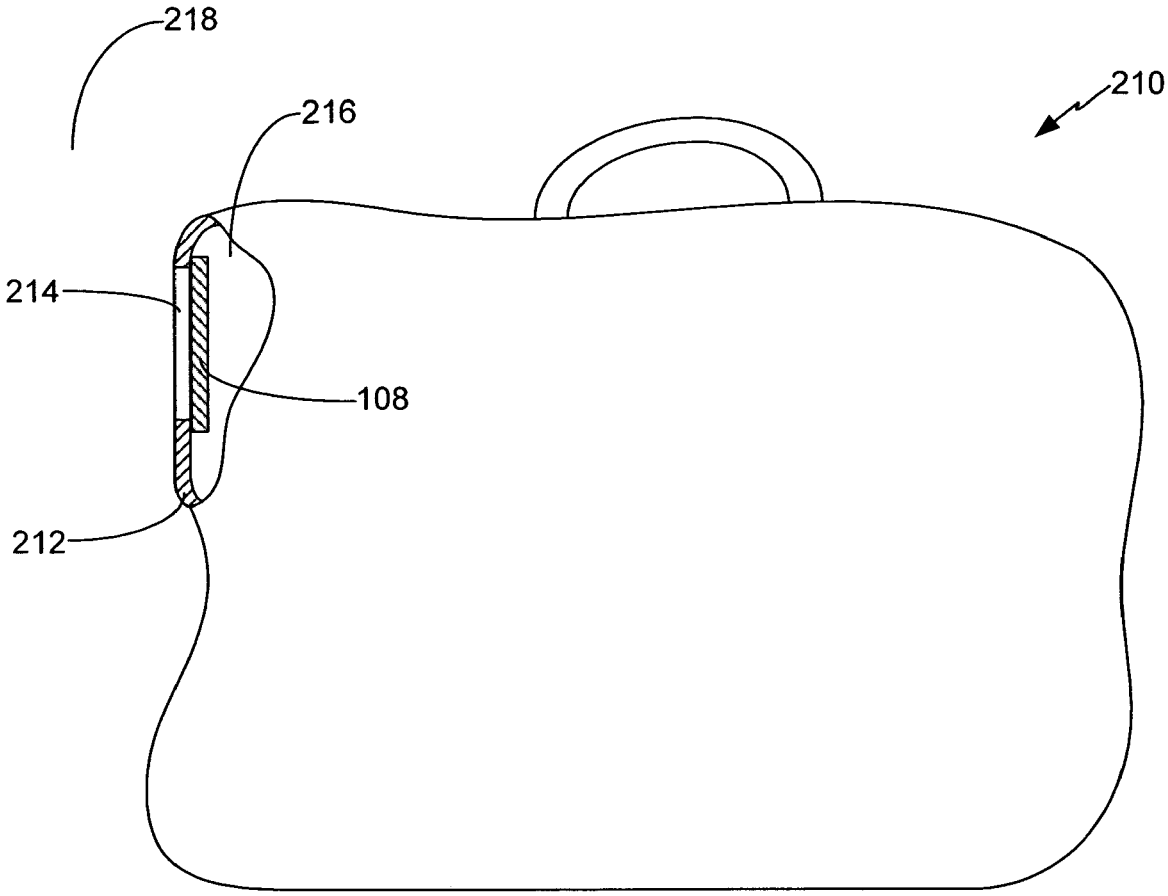
FIG. 10 is a simplified illustration of a duffel bag in partial cross section in accordance with embodiments of the invention.

Additional embodiments of the present invention are directed to the application of the odor absorbing system to items other than articles of clothing where odor absorption is desired. Such items include containers, such as shoe bags, duffel bags, luggage, laundry bags, and other types of containers. FIG. 10 is a simplified illustration of a duffel bag 210 in partial cross-section in accordance with this embodiment of the invention. In general, the duffel bag 210 is primarily constructed of an outer layer of material 212 that is preferably substantially non-breathable. A vent 214 is formed in the outer layer of material to provide an airflow path between an interior chamber 216 of the duffel bag and the outside environment 218. A scent absorbing insert 108 is positioned to cover the vent 214 to force the airflow to flow through the odor absorbing insert 108. The odor absorbing insert 108 is preferably removably attached to the layer 212 using any of the methods described above.

Although the present invention has been described with reference to preferred embodiments, workers skilled in the art will recognize that changes may be made in form and detail without departing from the spirit and scope of the invention.

What is claimed is:

1. An odor absorbing system comprising:

an upper body covering article of clothing configured to be worn by a person including a base layer adapted to substantially surround a portion of the person wearing the article of clothing, the base layer of the article of clothing comprising a torso section and arm sections each connected to the torso section, the torso and arm sections respectively configured to substantially cover the torso and arms of the person wearing the article of clothing, wherein the base layer includes a vent and is formed of a material that is less breathable than the vent;

a fastener; and an odor absorbing insert removably attachable to the article of clothing adjacent the vent using the fastener, the insert including a layer of breathable material and an odor absorbing agent on the layer of breathable material.

2. The system of claim 1, wherein the fastener includes a breathable pocket attached to the base layer adjacent the vent, the breathable pocket including first and second layers of breathable material spanning the vent and defining an interior chamber, wherein the odor absorbing insert is removably receivable within the interior chamber.

3. The system of claim 2, wherein the odor absorbing insert is removably contained within the interior chamber of the breathable pocket.

4. The system of claim 2, wherein the odor absorbing insert is sized to lay substantially flat within the interior chamber of the breathable pocket.

5. The system of claim 2, wherein the breathable pocket is removably attached to the base layer at a perimeter of the vent.

6. The system of claim 1, wherein the odor absorbing agent is selected from a group consisting of activated carbon, charcoal, chlorophyll, baking soda, activated alumni, soda, lime, zeolite, calcium oxide, potassium permanganate, and cyclodextrin.

7. The system of claim 1, wherein at least one of the odor absorbing insert and the base layer of the article of clothing includes an anti-microbial agent.

8. The system of claim 1, wherein the vent is located within an armpit section of the base layer that is adjacent the torso and arm sections and is configured to be positioned adjacent an armpit of the person wearing the article of clothing.

9. The system of claim 1, wherein the vent is within a shoulder section of the base layer that is adjacent a junction between the torso and arm sections and is configured to be located adjacent a shoulder of the person wearing the article of clothing.

10. The system of claim 1, wherein the vent is located below a neckline of the torso section of the base layer and is configured to overlay an upper chest of the person wearing the article of clothing.

11. The system of claim 1, wherein the vent is located below a neckline of the torso section of the base layer and is configured to overlay an upper back of the person wearing the article of clothing.

12. The system of claim 1, wherein the article of clothing includes a neckline attached to the torso section and configured to squeeze a neck of the person wearing the article of clothing.

13. The system of claim 1, wherein the article of clothing includes a waistline attached to the torso section of the base layer and configured to squeeze a waist of the person wearing the article of clothing.

14. The system of claim 1, wherein the article of clothing includes a pair of cuffs each attached to an end of one of the arm sections of the base layer and configured to squeeze a wrist of the person wearing the article of clothing.

15. The system of claim 1, wherein the fastener is selected from a group consisting of a hook and loop fastener, a button, and a zipper.

16. The system of claim 1, including a sealable container configured to receive the odor absorbing insert.

17. An odor absorbing system comprising:

an upper body covering article of clothing configured to be worn by a person including a base layer comprising a torso section configured to substantially cover a torso of the person and arm sections connected to the torso section and configured to substantially cover arms of the person, wherein the base layer includes a plurality of vents and is formed of a material that is less breathable than the vents, the base layer being configured to restrict airflow at a primary opening of the article of clothing;

a plurality of fasteners; and a plurality of odor absorbing inserts removably attachable to the article of clothing adjacent the vents using the fasteners, each insert including a layer of breathable material and an odor absorbing agent on the layer of breathable material.

18. The system of claim 17, wherein each fastener comprises a breathable pocket including first and second layers of breathable materials spanning one of the vents and defining an interior chamber, wherein each of the odor absorbing inserts is removably receivable within one of the interior chambers of the breathable pockets.

19. The system of claim 18, wherein each of the odor absorbing inserts is removably contained in the interior chamber of one of the breathable pockets.

20. The system of claim 18, wherein at least one breathable pocket is removably connected to the base layer at a perimeter of one of the vents.

21. The system of claim 17, wherein the odor absorbing agent is selected from a group consisting of activated carbon, charcoal, chlorophyll, baking soda, activated alumni, soda, lime, zeolite, calcium oxide, potassium permanganate, and cyclodextrin.

22. The article of clothing of claim 17, wherein at least one of the odor absorbing inserts and the base layer of the article of clothing includes an anti-microbial agent.

23. The system of claim 17, wherein:

the vents include a pair of armpit vents each located at an armpit section of the base layer that is adjacent the torso section and one of the arm sections and is positioned to be located at an armpit of the person wearing the article of clothing; and the plurality of odor absorbing inserts include an odor absorbing insert adjacent each of the armpit vents.

24. The system of claim 23 including a pair of breathable pockets each including first and second layers of breathable material spanning one of the armpit vents and defining an interior chamber, in which one of the odor absorbing inserts is removably contained.

25. The system of claim 23, wherein the article of clothing includes a neckline attached to the torso section of the base layer and configured to squeeze a neck of the person wearing the article of clothing.

26. The system of claim 23, wherein the article of clothing includes a waistline attached to the torso section of the base layer and configured to squeeze a waist of the person wearing the article of clothing.

27. The system of claim 23, wherein the article of clothing includes a pair of cuffs each attached to an end of one of the arm sections of the base layer and configured to squeeze a wrist of the person wearing the article of clothing.

28. The system of claim 23 wherein:

the vents include a pair of shoulder vents each located at a shoulder section of the base layer that is adjacent a junction between the torso and arm sections and is configured to be located adjacent a shoulder of the person wearing the article of clothing; and the plurality of odor absorbing inserts include an odor absorbing insert adjacent each of the shoulder vents.

29. The system of claim 17 wherein:

the vents include a pair of shoulder vents each located at a shoulder section of the base layer that is adjacent a junction between the torso and arm sections and is configured to be located adjacent a shoulder of the person wearing the article of clothing; and the plurality of odor absorbing inserts include an odor absorbing insert adjacent each of the shoulder vents.

30. The system of claim 29, wherein:

the vents include a pair of armpit vents each located at an armpit section of the base layer that is adjacent the torso section and one of the arm sections and is positioned to be located at an armpit of the person wearing the article of clothing; and the plurality of odor absorbing inserts include an odor absorbing insert adjacent each of the armpit vents.

31. The system of claim 29, wherein:

the vents include a vent located below a neckline of the torso section of the base layer and is configured to overlay one of an upper back and an upper chest of the person wearing the article of clothing; and the plurality of odor absorbing inserts include an odor absorbing insert adjacent the vent located below the neckline of the torso section.

32. The system of claim 17, wherein:

the vents include a vent located below a neckline of the torso section of the base layer and is configured to overlay one of an upper back and an upper chest of the person wearing the article of clothing; and the plurality of odor absorbing inserts include an odor absorbing insert adjacent the vent located below the neckline of the torso section.

33. A method of reducing odor emanation from a person into an environment surrounding the person while hunting comprising steps of:

providing an upper body covering article of clothing configured to be worn by a person including a base layer having a vent, the base layer comprising a torso section and arm sections each connected to the torso section, wherein the base layer of the article of clothing is formed of a material that is less breathable than the vent;

providing an odor absorbing insert comprising breathable material and an odor absorbing agent in a sealed container;

removing the odor absorbing insert from the sealed container;

removably attaching the odor absorbing insert to the article of clothing adjacent to the vent;

wearing the article of clothing including surrounding a torso of a person with the torso section of the base layer and inserting the arms of the person into the arm sections of the base layer; and hunting wildlife while wearing the article of clothing.

34. The method of claim 33, wherein:

the article of clothing includes a breathable pocket attached to the base layer adjacent the vent; and the attaching step comprises containing the odor absorbing insert in an interior chamber of the breathable pocket.

35. The method of claim 33, wherein at least one of the odor absorbing insert and the base layer includes an anti-microbial agent.

36. The method of claim 33, wherein:

the vent within the base layer is located at an armpit section that is adjacent the torso and arm sections; and the wearing step includes positioning the vent at an armpit of the person thereby placing the odor absorbing insert adjacent the armpit of the person.

37. The method of claim 33, wherein:

the vent in the base layer is located at a shoulder section that is adjacent a junction between the torso and arm sections of the base layer; and the wearing step includes positioning the vent adjacent a shoulder of the person thereby placing the odor absorbing insert adjacent the shoulder of the person.

38. The method of claim 33, wherein:

the vent in the base layer is located below a neckline of the torso section; and the wearing step includes positioning the vent such that it overlays an upper chest of the person.

39. The method of claim 33, wherein:

the vent in the base layer is located below a neckline of the torso section of the base layer; and the wearing step includes positioning the vent to overlay an upper back of the person.

40. The system of claim 33, wherein:

the base layer of the article of clothing includes at least one primary opening through which a portion of the person wearing the article of clothing extends; and the method includes restricting airflow through the primary opening when the article of clothing is worn by the person.

41. The method of claim 40, wherein:

the article of clothing includes a neckline attached to the base layer;

the wearing step includes positioning the neckline around a neck of the person; and the restricting step includes squeezing the neck of the person with the neckline.

42. The method of claim 40, wherein:

the article of clothing includes a waistline attached to the torso section of the base layer;

the wearing step includes positioning the waistline around a waist of the person; and the restricting step includes squeezing the waist of the person with the waistline.

43. The method of claim 33, further comprising, after the wearing step, removing the odor absorbing insert from the article of clothing and placing the odor absorbing insert in the sealed container.

44. An odor absorbing system comprising:

an upper body covering article of clothing configured to be worn by a person including a base layer comprising a torso section and arm sections each connected to the torso section, the torso and arm sections respectively configured to substantially cover a portion of a torso and arms of the person wearing the article of clothing, wherein the base layer includes a vent and is formed of a material that is less breathable than the vent;

a breathable pocket attached to the article of clothing adjacent the vent, the breathable pocket including an interior chamber that is accessible through an opening; and an odor absorbing insert including a layer of breathable material and an odor absorbing agent on the layer of breathable material, wherein the insert is removably receivable in the breathable pocket through the opening.

45. The system of claim 44, wherein the odor absorbing insert is sized to lay substantially flat within the interior chamber of the breathable pocket.

46. The system of claim 44, wherein the breathable pocket is removably attached to the base layer at a perimeter of the vent.

47. The system of claim 44, wherein the odor absorbing agent is selected from a group consisting of activated carbon, charcoal, chlorophyll, baking soda, activated alumni, soda, lime, zeolite, calcium oxide, potassium permanganate, and cyclodextrin.

48. The system of claim 44, wherein at least one of the odor absorbing insert and the base layer of the article of clothing includes an anti-microbial agent.

49. The system of claim 44, wherein:

the vent is located within an armpit section of the base layer that is adjacent the torso and arm sections and is configured to be positioned adjacent an armpit of the person wearing the article of clothing.

50. The system of claim 44, further comprising a sealable container configured to receive the odor absorbing insert.

51. The system of claim 44, wherein the upper body covering article of clothing is configured to restrict airflow through primary openings in the article of clothing when worn by a person; whereby air contained within the article of clothing is encouraged to flow through the vents rather than the primary openings of the article of clothing, when worn by a person.

* * * * *